US009360259B2

(12) United States Patent
Oritani et al.

(10) Patent No.: US 9,360,259 B2
(45) Date of Patent: Jun. 7, 2016

(54) HEAT EXCHANGER AND INDOOR UNIT PROVIDED WITH THE SAME

(75) Inventors: Yoshio Oritani, Sakai (JP); Masanori Jindou, Sakai (JP); Hideki Sawamizu, Sakai (JP); Yoshimasa Kikuchi, Sakai (JP); Kanji Akai, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 981 days.

(21) Appl. No.: 13/391,060

(22) PCT Filed: Oct. 26, 2010

(86) PCT No.: PCT/JP2010/068926

§ 371 (c)(1),
(2), (4) Date: Feb. 17, 2012

(87) PCT Pub. No.: WO2011/055656

PCT Pub. Date: May 12, 2011

(65) Prior Publication Data

US 2012/0145364 A1 Jun. 14, 2012

(30) Foreign Application Priority Data

Nov. 4, 2009 (JP) ..... 2009-253210

(51) Int. Cl.
*F28F 13/08* (2006.01)
*F24F 1/00* (2011.01)
(Continued)

(52) U.S. Cl.
CPC ..... *F28F 13/08* (2013.01); *F24F 1/0007* (2013.01); *F28D 1/024* (2013.01); *F28D 1/047* (2013.01);
(Continued)

(58) Field of Classification Search
CPC ..... F24F 1/18; F24F 1/48; F24F 1/50; F24F 1/52; F24F 1/54; F28F 13/08
USPC ..... 165/150, 147, 146, 151
See application file for complete search history.

(56) References Cited

U.S. PATENT DOCUMENTS 6,550,273 B2 * 4/2003 Fujitaka et al. ..... 62/498
2008/0282725 A1 * 11/2008 Ishibashi et al. ..... 62/426
(Continued)

FOREIGN PATENT DOCUMENTS

JP 62-156290 U 10/1987
JP 2-97897 A 4/1990
(Continued)

OTHER PUBLICATIONS

Abstract JP 2009-092288 A.*
(Continued)

*Primary Examiner* — Marc Norman
*Assistant Examiner* — Devon Russell
(74) *Attorney, Agent, or Firm* — Birch, Stewart, Kolasch & Birch, LLP

(57) ABSTRACT

A heat exchanger is provided in which a large number of plate-shaped fins are attached to outer peripheries of heat transfer tubes through which refrigerant flows. Three rows of heat transfer tubes are arranged along an air flow direction. An inlet side heat transfer tube in a case of using as an evaporator or an outlet side heat transfer tube in a case of using as a condenser has the smallest diameter. In a case where the most windward side heat transfer tube has the smallest diameter, a tube diameter of the most windward side heat transfer tube is D1, a tube diameter of the middle heat transfer tube is D2, and a tube diameter of the most leeward side is D3, D1<D2=D3, 4 mm≤D3≤10 mm, and 0.6≤D1/D3<1 are satisfied.

9 Claims, 7 Drawing Sheets

(51) Int. Cl.

| | |
|---|---|
| ***F28D 1/02*** | (2006.01) |
| ***F28D 1/04*** | (2006.01) |
| ***F28D 1/047*** | (2006.01) |
| ***F28F 1/32*** | (2006.01) |
| *F24F 13/30* | (2006.01) |
| *F28D 21/00* | (2006.01) |

(52) U.S. Cl.
CPC ..... *F28D 1/0417* (2013.01); *F28F 1/32* (2013.01); *F24F 1/0059* (2013.01); *F24F 13/30* (2013.01); *F24F 2001/0037* (2013.01); *F28D 2021/007* (2013.01); *F28D 2021/0071* (2013.01); *F28F 2210/08* (2013.01)

(56) References Cited

U.S. PATENT DOCUMENTS

2009/0084129 A1* 4/2009 Kim et al. ..... 62/502
2010/0205993 A1* 8/2010 Matsuda ..... F24F 1/0059 62/259.1

FOREIGN PATENT DOCUMENTS

| | | | | |
|---|---|---|---|---|
| JP | 8-338670 | A | 12/1996 | |
| JP | 11-257800 | A | 9/1999 | |
| JP | 2000-274982 | A | 10/2000 | |
| JP | 2000-329486 | A | 11/2000 | |
| JP | 2004-332958 | A | 11/2004 | |
| JP | 2006-329534 | A | 12/2006 | |
| JP | 2008-39278 | A | 2/2008 | |
| JP | 2008-111622 | A | 5/2008 | |
| JP | 2009-09228 | A * | 4/2009 | |
| JP | 2009-198055 | A | 9/2009 | |
| WO | WO-2009104439 | A1 * | 8/2015 | ..... F24F 1/0059 |

OTHER PUBLICATIONS

English Translation of JP 2009-092288 A.*

* cited by examiner

HEAT EXCHANGER AND INDOOR UNIT PROVIDED WITH THE SAME

TECHNICAL FIELD

The present invention relates to a heat exchanger and an indoor unit provided with the same. More particularly, the present invention relates to a heat exchanger in which plural rows of heat transfer tubes are arranged along the air flow direction, the heat exchanger being used for an air conditioner and the like, and an indoor unit provided with the same.

BACKGROUND ART

Conventionally, in an air conditioner and the like, there is frequently used a cross fin and tube type heat exchanger provided with a large number of plate-shaped fins provided side by side in an air flow supplied by a fan, and a plurality of heat transfer tubes inserted into holes formed in the fins and arranged so as to be substantially orthogonal to the air flow direction.

In such a cross fin and tube type heat exchanger, in general, plural rows or plural columns of heat transfer tubes are arranged along the air flow direction. In order to enhance a heat exchanging performance between a refrigerant flowing in the heat transfer tubes and the ambient air, there are various proposals regarding outer diameters of the heat transfer tubes, a pitch of the fins, and the like (for example, refer to Patent Literatures 1 to 2).

CITATION LIST

Patent Literature

Patent Literature 1: Japanese Unexamined Patent Publication No. 2000-274982

Patent Literature 2: Japanese Unexamined Patent Publication No. 2006-329534

SUMMARY OF INVENTION

Technical Problem

In a case where a heat exchanger is used as an evaporator, a refrigerant for performing heat exchange with the air is in a two-phase state of containing a large volume of a liquid refrigerant in an inlet part of the heat exchanger, and in a wet state or a superheated state in an outlet part of the heat exchanger. Meanwhile, in a case where the heat exchanger is used as a condenser, the refrigerant is in a superheated state in the inlet part of the heat exchanger and in a liquid state in the outlet part of the heat exchanger.

In such a way, a state of the refrigerant is changed while flowing in the heat exchanger due to the heat exchange with the air. However, selection of tube diameters of plural rows of heat transfer tubes in consideration with such a state change has not been proposed yet.

The present inventors variously examined, and as a result, found that by changing the tube diameters of the heat transfer tubes according to the state of the refrigerant, specifically regarding three rows of heat transfer tubes arranged along the air flow direction, by making an inlet side heat transfer tube in a case of using as the evaporator or an outlet side heat transfer tube in a case of using as the condenser has the smallest diameter, and by setting a tube diameter of a heat transfer tube on the opposite side of the heat transfer tube having the smallest diameter and a tube diameter ratio between two rows of the heat transfer tubes within a predetermined range, a heat exchanging performance can be improved while suppressing an increase in a pressure loss, and thus, the inventors completed the present invention.

That is, an object of the present invention is to provide a heat exchanger capable of improving the heat exchanging performance while suppressing the increase in the pressure loss.

Solution to Problem

A heat exchanger according to a first aspect of the present invention is a heat exchanger, in which a large number of plate-shaped fins are attached to outer peripheries of heat transfer tubes through which a refrigerant flows, the heat exchanger being for performing heat exchange with the air, wherein three rows of heat transfer tubes are arranged along an air flow direction, among the three rows of the heat transfer tubes, an inlet side heat transfer tube in a case of using as an evaporator or an outlet side heat transfer tube in a case of using as a condenser has the smallest diameter, in a case where the most windward side heat transfer tube has the smallest diameter, a tube diameter of the most windward side heat transfer tube is D1, a tube diameter of the middle heat transfer tube is D2, and a tube diameter of the most leeward side is D3, $D1<D2=D3$, $4\ mm \leq D3 \leq 10\ mm$, and $0.6 \leq D1/D3 < 1$ are satisfied, and in a case where the most leeward side heat transfer tube has the smallest diameter, the tube diameter of the most leeward side heat transfer tube is D1, the tube diameter of the middle heat transfer tube is D2, and the tube diameter of the most windward side is D3, $D1<D2=D3$, $4\ mm \leq D3 \leq 10\ mm$, and $0.6 \leq D1/D3 < 1$ are satisfied.

A heat exchanger according to a second aspect of the present invention is a heat exchanger, in which a large number of plate-shaped fins are attached to outer peripheries of heat transfer tubes through which a refrigerant flows, the heat exchanger being for performing heat exchange with the air, wherein three rows of heat transfer tubes are arranged along an air flow direction, among the three rows of the heat transfer tubes, an inlet side heat transfer tube in a case of using as an evaporator or an outlet side heat transfer tube in a case of using as a condenser has the smallest diameter, in a case where the most windward side heat transfer tube has the smallest diameter, a tube diameter of the most windward side heat transfer tube is D1, a tube diameter of the middle heat transfer tube is D2, and a tube diameter of the most leeward side is D3, $D1=D2<D3$, $5\ mm \leq D3 \leq 10\ mm$, and $0.64 \leq D1/D3 < 1$ are satisfied, and in a case where the most leeward side heat transfer tube has the smallest diameter, the tube diameter of the most leeward side heat transfer tube is D1, the tube diameter of the middle heat transfer tube is D2, and the tube diameter of the most windward side is D3, $D1=D2<D3$, $5\ mm \leq D3 \leq 10\ mm$, and $0.64 \leq D1/D3 < 1$ are satisfied.

A heat exchanger according to a third aspect of the present invention is a heat exchanger, in which a large number of plate-shaped fins are attached to outer peripheries of heat transfer tubes through which a refrigerant flows, the heat exchanger being for performing heat exchange with the air, wherein three rows of heat transfer tubes are arranged along an air flow direction, among the three rows of the heat transfer tubes, an inlet side heat transfer tube in a case of using as an evaporator or an outlet side heat transfer tube in a case of using as a condenser has the smallest diameter, in a case where the most windward side heat transfer tube has the smallest diameter, a tube diameter of the most windward side heat transfer tube is D1, a tube diameter of the middle heat transfer tube is D2, and a tube diameter of the most leeward side is D3, D1<D2<D3, 5 mm≤D3≤10 mm, and 0.5≤D1/D3<1 and 0.75≤D2/D3<1 are satisfied, and in a case where the most leeward side heat transfer tube has the smallest diameter, the tube diameter of the most leeward side heat transfer tube is D1, the tube diameter of the middle heat transfer tube is D2, and the tube diameter of the most windward side is D3, D1<D2<D3, 5 mm≤D3≤10 mm, and 0.5≤D1/D3<1 and 0.75≤D2/D3<1 are satisfied.

In the heat exchanger according to the first to third aspects of the present invention, among the three rows of the heat transfer tubes arranged along the air flow direction, the inlet side heat transfer tube in a case of using as the evaporator or the outlet side heat transfer tube in a case of using as the condenser has the smallest diameter. The tube diameters are equal or larger from the heat transfer tube having the smallest diameter toward a heat transfer tube on the opposite side of the above heat transfer tube. Regarding the tube diameter D1 of the heat transfer tube having the smallest diameter, the tube diameter D2 of the adjacent heat transfer tube, and the tube diameter D3 of the remaining heat transfer tube, D3 is set to be a value within a predetermined range, and a tube diameter ratio D1/D3 or D2/D3 is set to be a value within a predetermined range. Thus, a heat exchanging performance can be improved while suppressing an increase in a pressure loss.

For example, when the refrigerant after passing through an expansion valve (in a wet state of containing a large volume of a liquid refrigerant) flows through the most windward side heat transfer tube having the smallest diameter at the time of a cooling operation, a flow velocity of the refrigerant flowing through the heat transfer tube is increased. As a result, heat transfer efficiency between the refrigerant in the tube and the air outside the tube is increased. Thereby, heat exchange efficiency can be improved. Meanwhile, with the refrigerant in a wet state of containing a small volume of the liquid refrigerant or a superheated state, a heat transfer coefficient is not really increased even with a small diameter but only the pressure loss is increased. Thus, the other heat transfer tubes are made to have larger diameters than the tube diameter of the most windward side heat transfer tube.

In this case, at the time of a heating operation, a gas refrigerant compressed by a compressor is supplied to the most leeward side heat transfer tube, and sent from the most windward side heat transfer tube to the expansion valve. As well as the time of the cooling operation, the refrigerant in a wet state of containing a large volume of the liquid refrigerant flows through the most windward side heat transfer tube having the smallest diameter. Thus, the flow velocity of the refrigerant flowing through the heat transfer tube is increased, and as a result, the heat transfer efficiency between the refrigerant in the tube and the air outside the tube is increased. Thereby, the heat exchange efficiency can be improved.

The tube diameter of the heat transfer tube having the smallest diameter is preferably within a range of 3 to 4 mm. Since the tube diameter is within this range, the heat transfer coefficient can be increased while ensuring a certain flow rate of the refrigerant.

A width of the plate-shaped fin attached to the heat transfer tube having the smallest diameter is preferably larger than widths of the plate-shaped fins attached to the other heat transfer tubes. In this case, by increasing a fin area around the heat transfer tube with the increased heat transfer coefficient, the heat exchanging performance can be further improved.

An indoor unit of the present invention is an indoor unit, including the heat exchanger according to any of the first to third aspects, and a fan for making an air flow through the heat exchanger, wherein the heat transfer tube having the smallest diameter is arranged on the most windward side, and a refrigerant flowing through the heat transfer tubes and an air flow are parallel flows at the time of a cooling operation while being counter flows at the time of a heating operation.

Since the indoor unit of the present invention includes the above heat exchanger, the heat exchanging performance can be improved while suppressing the increase in the pressure loss. At the time of the heating operation when the heat exchanger functions as the condenser, by making the tube diameter of the heat transfer tube in the row where the refrigerant containing a large volume of the liquid refrigerant flows the smallest, a degree of supercooling (subcooling) is increased, so that a COP at the time of heating can be increased. Further, an APF largely influenced by the COP at the time of heating can be largely improved.

The tube diameter of the heat transfer tube having the smallest diameter is preferably within a range of 3 to 4 mm. Since the tube diameter is within this range, the heat transfer coefficient can be increased while ensuring a certain flow rate of the refrigerant.

A width of the plate-shaped fin attached to the heat transfer tube having the smallest diameter is preferably larger than widths of the plate-shaped fins attached to the other heat transfer tubes. In this case, by increasing a fin area around the heat transfer tube with the increased heat transfer coefficient, the heat exchanging performance can be further improved.

The fan can be arranged in a substantially center of a casing arranged on the back side of a ceiling, the heat exchanger can be arranged in the casing so as to surround the fan, and the innermost side heat transfer tube or the outermost side heat transfer tube of the heat exchanger can have the smallest diameter. In this case, in a ceiling-buried type indoor unit, the heat exchanging performance can be improved while suppressing the increase in the pressure loss.

Preferably, the heat transfer tube having the smallest diameter is arranged on the innermost side, and the refrigerant flowing through the heat transfer tubes and an air flow are parallel flows at the time of a cooling operation while being counter flows at the time of a heating operation. In this case, at the time of the heating operation when the heat exchanger functions as the condenser, by making the tube diameter of the heat transfer tube in the innermost side (windward side) row where the refrigerant containing a large volume of the liquid refrigerant flows the smallest, a degree of supercooling (subcooling) is increased, so that a COP at the time of heating can be increased. Further, an APF largely influenced by the COP at the time of heating can be largely improved.

Advantageous Effect of Invention

According to the heat exchanger of the present invention, the heat exchanging performance can be improved while suppressing the increase in the pressure loss.

DESCRIPTION OF EMBODIMENTS

Hereinafter, an embodiment of a heat exchanger of the present invention and an indoor unit provided with the same will be described in detail with reference to the attached drawings.

Figure 1:
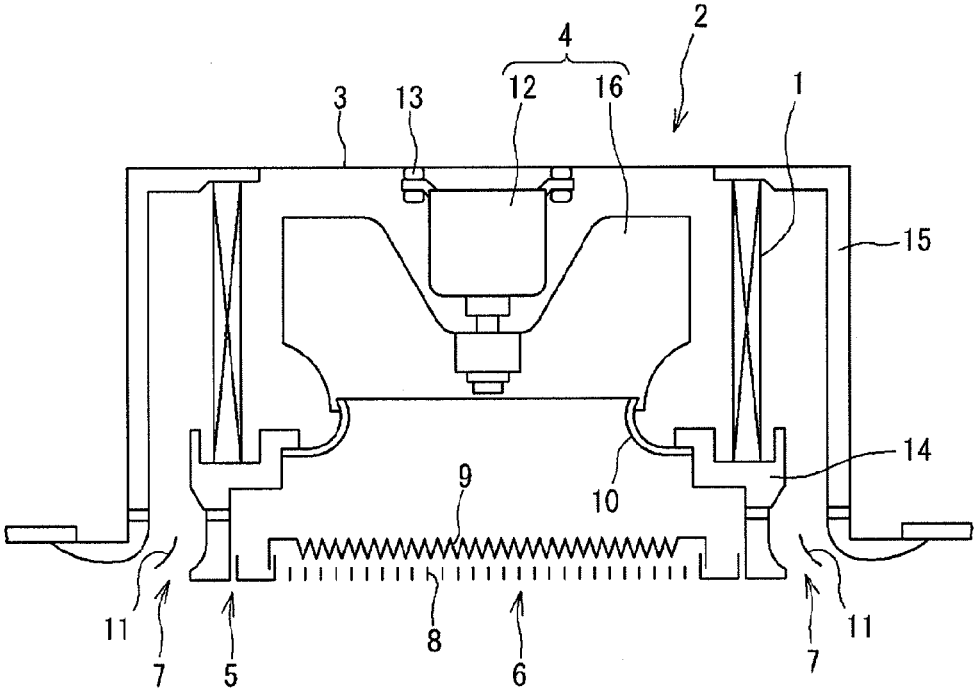
FIG. 1 is a sectional illustrative view of an indoor unit provided with one embodiment of a heat exchanger of the present invention.

FIG. 1 is a sectional illustrative view of an indoor unit 2 provided with a heat exchanger 1 according to one embodiment of the present invention. The indoor unit 2 is a ceiling-buried type indoor unit arranged on the back side of a ceiling. A fan 4 is arranged in a substantially center of a casing 3, and the substantially annular heat exchanger 1 is arranged in the casing 3 so as to surround the fan 4.

A decorative panel 5 is arranged so as to cover an opening in a center of a lower surface of the casing 3. The decorative panel 5 has an air inlet 6 for suctioning the air in an air-conditioned room, and four air outlets 7 arranged so as to form a rectangle in an outer periphery of the air inlet 6.

A suction grille 8, a filter 9 for removing grit, dust, and the like in the air suctioned from the suction grille 8, and a bell mouth 10 for guiding the air suctioned from the air inlet 6 into the casing 3 are arranged in the air inlet 6.

At each air outlet 7, there is provided a flap 11 oscillated about a shaft extending in the longitudinal direction of the air outlet 7 by a motor (not shown). The fan 4 is a centrifugal fan for suctioning the air in the air-conditioned room into the casing 3 through the air inlet 6 and blowing off the air in the outer peripheral direction. A motor 12 forming the fan 4 is fixed to the casing 3 via a vibration-proof rubber 13. It should be noted that in FIG. 1, the reference sign 14 denotes a drain pan for storing condensed water from the heat exchanger 1, and the reference sign 15 denotes an insulating member arranged on an inner peripheral surface of the casing 3.

Figure 2:
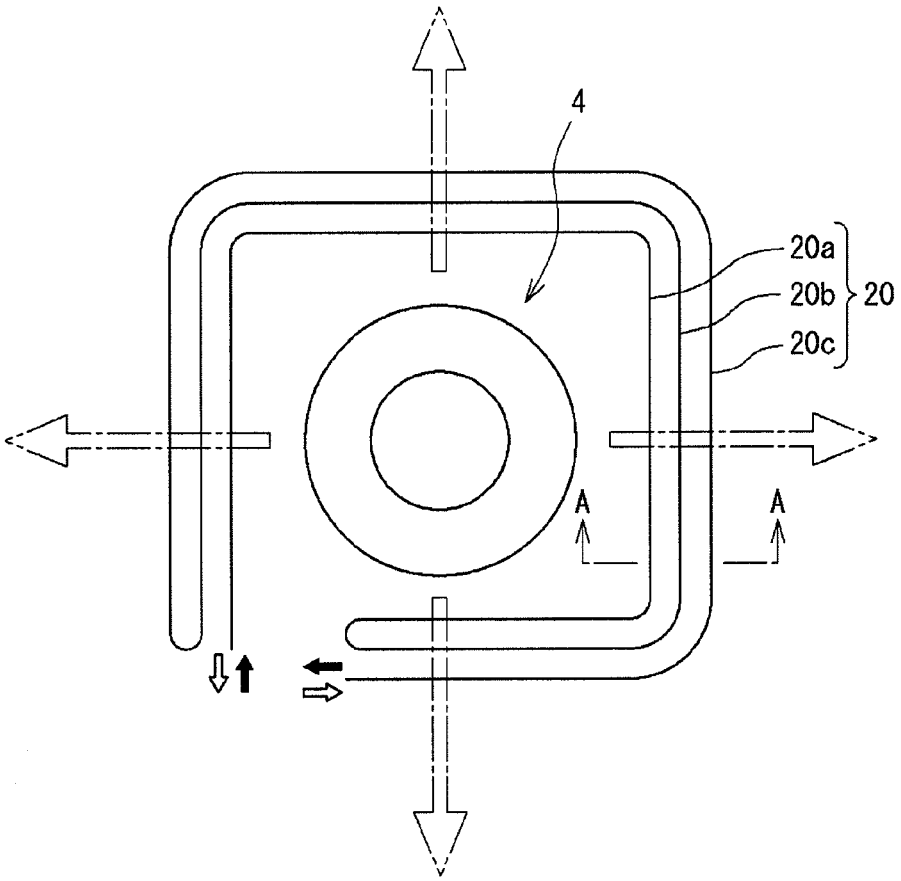
FIG. 2 is a plan illustrative view of the heat exchanger shown in FIG. 1.

As shown in FIG. 2, the heat exchanger 1 is a cross fin and tube type heat exchanger panel formed by bending so as to surround an outer periphery of the fan 4 and connected to an outdoor unit (not shown) installed in an outdoor site or the like via a refrigerant pipe. The heat exchanger 1 is formed so as to function as an evaporator for a refrigerant flowing inside at the time of a cooling operation and a condenser for the refrigerant flowing inside at the time of a heating operation, respectively. The heat exchanger 1 can perform heat exchange with the air suctioned into the casing 3 through the air inlet 6 and blown off from a fan rotor 16 of the fan 4, so as to cool the air at the time of the cooling operation while heating the air at the time of the heating operation.

Figure 3:
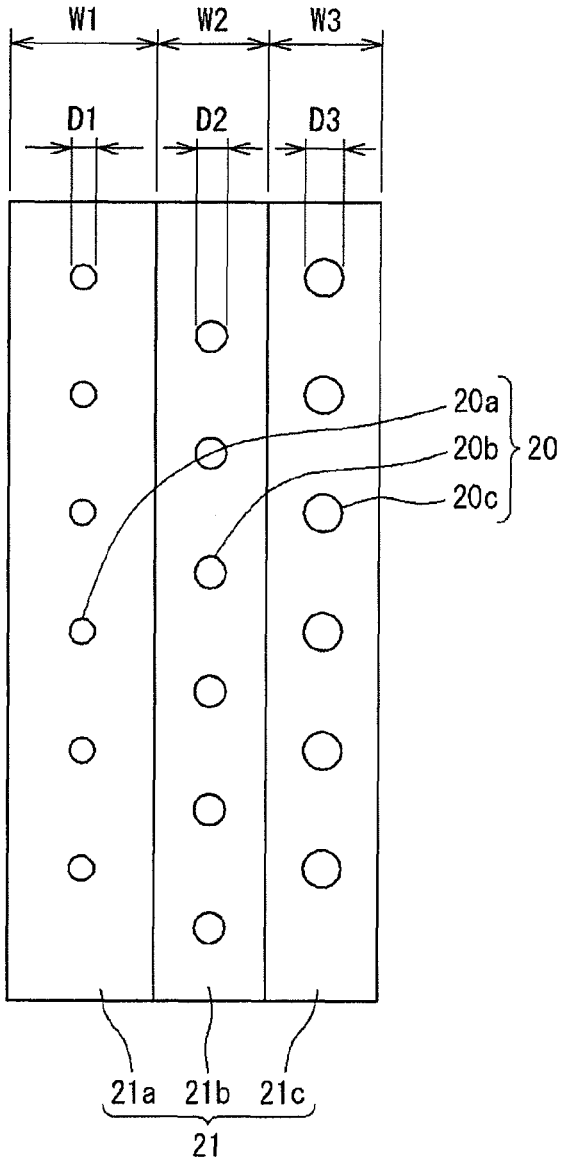
FIG. 3 is a sectional view taken along the line A-A of FIG. 2.

In the heat exchanger 1 of the present embodiment, three rows of heat transfer tubes 20 are arranged along the air flow direction (the radially outward direction with taking the fan 4 as a center shown by chain line arrows in FIG. 2), and a large number of plate-shaped fins 21 are attached to outer peripheries of the heat transfer tubes 20. As shown in FIG. 3, six columns of heat transfer tubes 20 are provided along the direction substantially orthogonal to an air flow (the up and down direction in FIG. 1). As materials of the heat transfer tubes 20 and the plate-shaped fins 21, copper and aluminum serving as general materials can be respectively adopted.

In the heat exchanger 1 of the present embodiment, the innermost row heat transfer tube 20*a* on the most windward side has the smallest diameter. That is, at the time of the cooling operation when functioning as the evaporator, a refrigerant whose pressure is lowered by an expansion valve (not shown) (a refrigerant in a wet state of containing a large volume of a liquid refrigerant) is supplied to the innermost row heat transfer tube 20*a*, and the refrigerant in a wet state or a gas state is sent out from the outermost row heat transfer tube 20*c* on the most leeward side to a compressor (not shown) in a subsequent stage (black arrows in FIG. 2). Meanwhile, at the time of the heating operation when functioning as the condenser, a gas refrigerant of a high temperature and high pressure compressed by the compressor is supplied to the outermost row heat transfer tube 20*c*, and a liquid refrigerant or a supercooled liquid refrigerant is supplied from the innermost row heat transfer tube 20*a* to the expansion valve in a subsequent stage (white arrows in FIG. 2).

In the heat transfer tubes 20 of the heat exchanger 1, the innermost row heat transfer tube 20*a* has the smallest diameter. Specifically, an outer diameter D1 of the innermost row heat transfer tube 20*a* is 4 mm, an outer diameter of the heat transfer tube 20*b* of an outer diameter D2 in the middle row is 5 mm, and an outer diameter D3 of the outermost row heat transfer tube 20*c* is 6 mm. That is, the tube diameters of the three rows are selected so as to satisfy $D1<D2<D3$, $5\ mm \leq D3 \leq 10\ mm$, and $0.5 \leq D1/D3 < 1$ or $0.75 \leq D2/D3 < 1$.

In any case of the time of the cooling operation and the time of the heating operation, the liquid refrigerant or the refrigerant in a wet state of containing a large volume of the liquid refrigerant flows through the innermost row heat transfer tube 20*a* having the smallest diameter. When the tube diameter of the innermost row heat transfer tube 20*a* through which such a refrigerant flows has a small diameter, a flow velocity of the refrigerant flowing through the heat transfer tube 20*a* is increased. As a result, heat transfer efficiency between the refrigerant in the tube and the air outside the tube is increased. Thereby, heat exchange efficiency can be improved. Meanwhile, with the refrigerant in a wet state of containing a small volume of the liquid refrigerant or a superheated state, a heat transfer coefficient is only increased less than the liquid refrigerant even with a small diameter but only a pressure loss is increased. Thus, the tube diameters D2, D3 of the heat transfer tube 20*b* and the heat transfer tube 20*c* are larger diameters than the outer diameter D1 of the innermost row heat transfer tube 20*a*. Thereby, a heat exchanging performance can be improved while suppressing an increase in the pressure loss.

Figure 4:
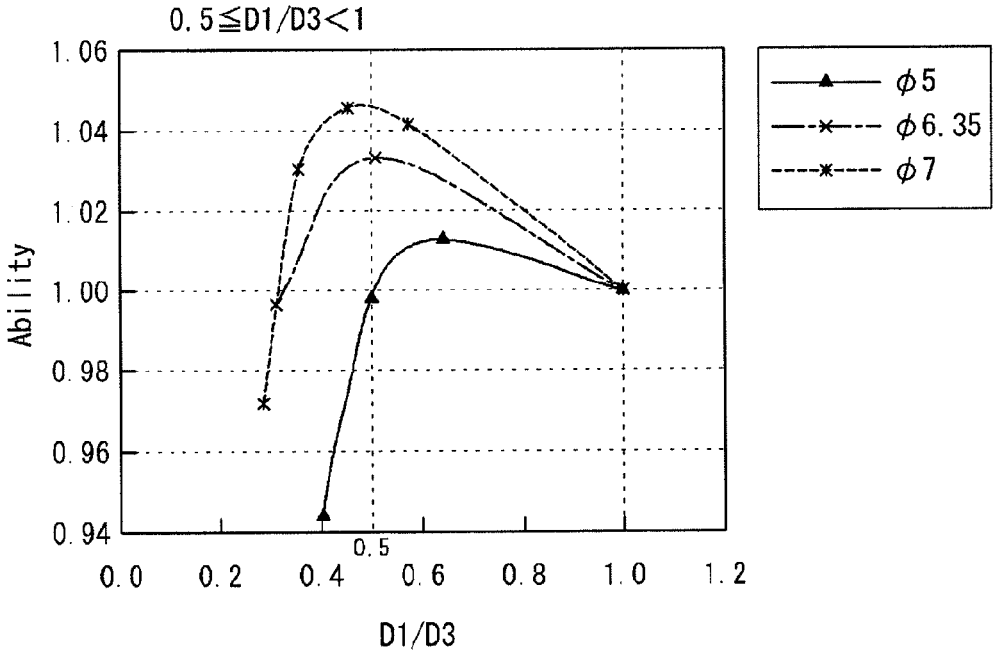
FIG. 4 is a graph showing a performance of the heat exchanger of the present invention.
Figure 5:
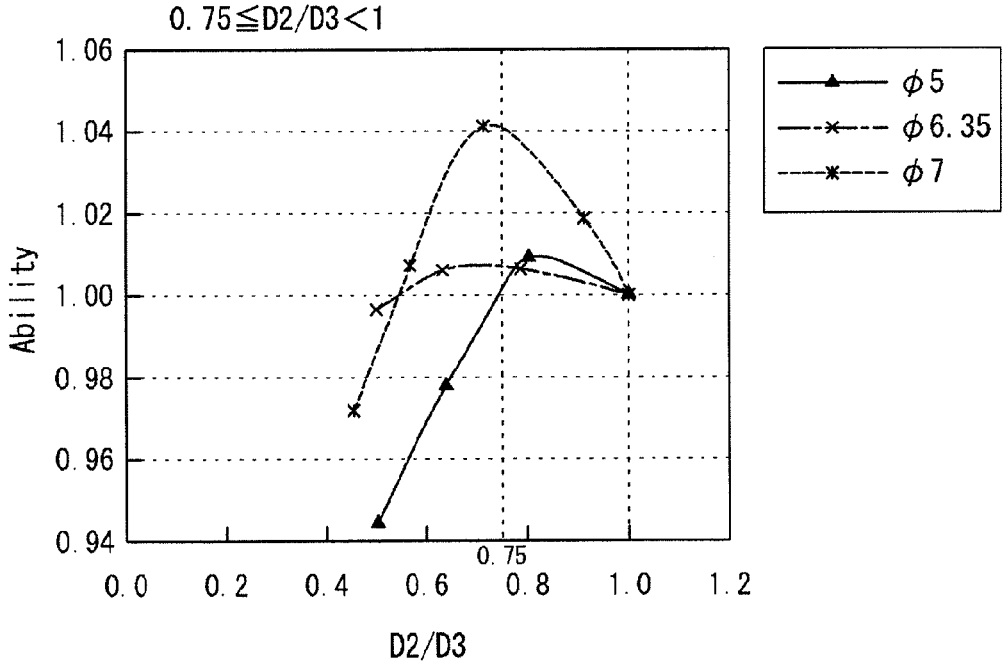
FIG. 5 is a graph showing a performance of the heat exchanger of the present invention.

FIGS. 4 and 5 are graphs showing performances of the heat exchanger of the present invention respectively in a case of $D1<D2<D3$. FIG. 4 evaluates the performance of the heat exchanger by changing the tube diameter D3 of the most leeward side heat transfer tube and a tube diameter ratio between the two heat transfer tubes, specifically, a ratio between the tube diameter D1 of the most windward side heat transfer tube having the smallest diameter and the tube diameter D3 of the most leeward side heat transfer tube (D1/D3). Meanwhile, FIG. 5 evaluates the performance of the heat exchanger by changing the above D3 and a ratio between the tube diameter D2 of the middle heat transfer tube and the tube diameter D3 of the most leeward side heat transfer tube (D2/D3).

In FIGS. 4 and 5, the performance of the heat exchanger is examined over three cases where the tube diameter D3 of the most leeward side heat transfer tube is 5 mm, 6.35 mm, and 7 mm. In each of the cases, an ability of the heat exchanger when D1=D2=D3 is 1.00 (a reference value), and the performance of the heat exchanger is evaluated in relative comparison with the above ability.

From FIG. 4, it is found that in all the three cases where the tube diameter D3 is 5 mm, 6.35 mm, and 7 mm, as the tube diameter ratio (D1/D3) is decreased less than 1, the ability of the heat exchanger is increased more than a case where the tube diameters of the three rows are all equal to each other at the beginning, reaches a peak in due course, and is decreased after that. It can be thought that although an effect of improving the heat exchange efficiency due to the small tube diameter is large at the beginning and the effect contributes to ability improvement, the ability is lowered in due course by an influence of the increase in the pressure loss due to the too small tube diameter. It can be thought that changes in FIGS. 5 to 7 described later (the ability is improved at the beginning and reaches a peak in due course, and the ability is lowered after that) are generated for the same reason.

There is a tendency that the smaller the tube diameter D3 is, the earlier the ability reaches a peak. It is found that in a case where the tube diameter ratio (D1/D3) is 0.5 and the tube diameter D3 is 5 mm, the ability of the heat exchanger is substantially equal to a case where the tube diameters of the three rows are all equal to each other.

From FIG. 5, it is found that in all the three cases where the tube diameter D3 is 5 mm, 6.35 mm, and 7 mm, as the tube diameter ratio (D2/D3) is decreased less than 1, the ability of the heat exchanger is increased more than a case where the tube diameters of the three rows are all equal to each other at the beginning, reaches a peak in due course, and is decreased after that. It is found that in a case where the tube diameter ratio (D2/D3) is 0.75 and the tube diameter D3 is 5 mm, the ability of the heat exchanger is substantially equal to a case where the tube diameters of the three rows are all equal to each other.

In FIGS. 4 and 5, a value of the largest tube diameter D3 is 7 mm. However, it is presumed that even in a case where the tube diameter D3 is more than 7 mm, the same tendency as a case where the tube diameter D3 is 5 mm, 6.35 mm, or 7 mm is shown.

As described above, from FIGS. 4 and 5, it is found that when satisfying 5 mm≤D3≤10 mm, and 0.5≤D1/D3<1 and 0.75≤D2/D3<1, the performance of the heat exchanger is improved more than a case where the tube diameters of the three rows are all equal to each other (D1=D2=D3).

In the present embodiment, the diameter is gradually increased to 4 mm, 5 mm, and 6 mm from the innermost row heat transfer tube 20*a* toward the outermost row heat transfer tube 20*c*, that is, in the direction of going away from the innermost row heat transfer tube 20*a*. By making the tube diameter of the heat transfer tube through which the liquid refrigerant or the refrigerant in a wet state of containing a large volume of the liquid refrigerant flows the smallest and gradually changing the tube diameter such that as a ratio of the liquid refrigerant is decreased, the tube diameter of the heat transfer tube is increased, the heat exchanging performance can be furthermore improved while balancing improvement of the heat transfer coefficient and the increase in the pressure loss.

In the present invention, the innermost row heat transfer tube 20*a* is not limited to 4 mm but can be appropriately selected for example within a range of 3 to 7 mm as long as the heat transfer tube is the smallest in the three rows of the heat transfer tubes. Among the above range, the heat transfer tube is preferably selected within a range of 3 to 4 mm since the heat transfer coefficient can be increased while ensuring a certain flow rate of the refrigerant.

The tube diameter of the heat transfer tube 20*b* in the middle row can be selected for example within a range of 4 to 8 mm. Further, the tube diameter of the outermost row heat transfer tube 20*c* can be selected for example within a range of 5 to 10 mm.

In the present embodiment, as shown in FIG. 3, a width W1 of the fin 21*a* attached to the innermost row heat transfer tube 20*a* is larger than a width W2 of the fin 21*b* attached to the heat transfer tube 20*b* in the middle row and a width W3 of the fin 21*c* attached to the outermost row heat transfer tube 20*c*. Specifically, the widths W1, W2, and W3 are 13 mm, 10 mm, and 10 mm, respectively. In such a way, by increasing an area of the fin 21*a* of the innermost row heat transfer tube 20*a* having the smallest diameter through which the liquid refrigerant or the refrigerant in a wet state of containing a large volume of the liquid refrigerant flows, that is, the fin around the heat transfer tube with the increased heat transfer coefficient, the heat exchanging performance can be further improved.

It should be noted that although the tube diameters D1, D2, D3 of the three rows of the heat transfer tubes satisfy D1<D2<D3 in the above embodiment, the present invention is not limited to this. As long as the tube diameter of the heat transfer tube on the most windward side or the most leeward side is the smallest diameter, the tube diameters may satisfy D1<D2=D3 or D1=D2<D3.

In a case of D1<D2=D3, the tube diameters D1, D2, D3 of the three rows of the heat transfer tubes are selected so as to satisfy 4 mm≤D3≤10 mm and 0.6≤D1/D3<1.

In a case of D1=D2<D3, the tube diameters D1, D2, D3 of the three rows of the heat transfer tubes are selected so as to satisfy 5 mm≤D3≤10 mm and 0.64≤D1/D3<1.

Figure 6:
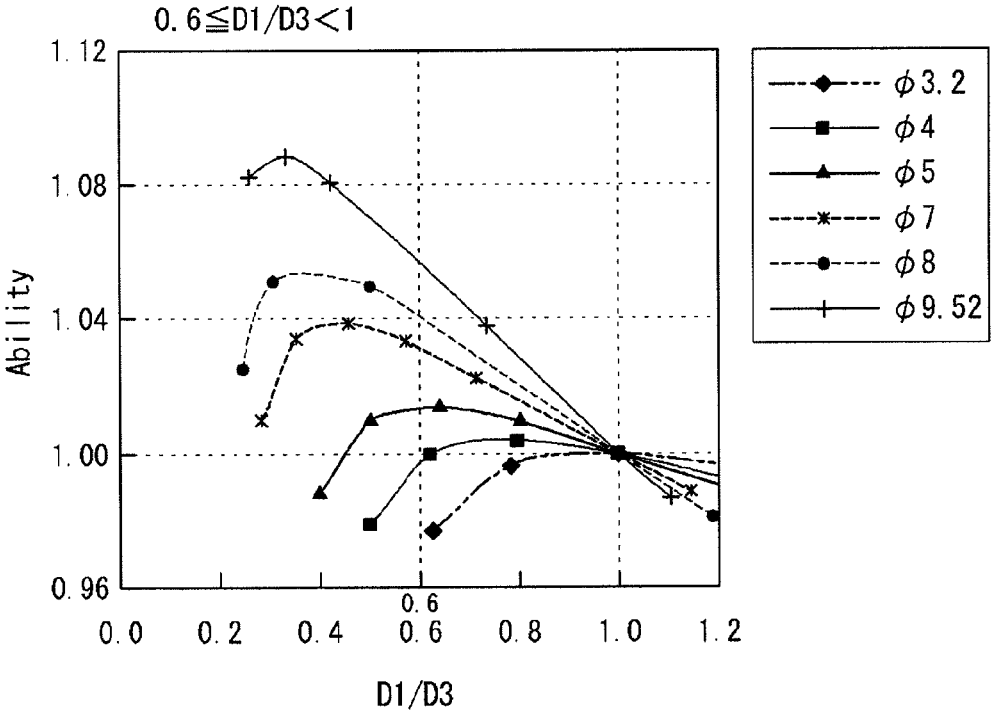
FIG. 6 is a graph showing a performance of the heat exchanger of the present invention.

FIG. 6 is a graph showing a performance of the heat exchanger of the present invention in a case of D1<D2=D3. The performance of the heat exchanger is evaluated by changing the tube diameter D3 of the most leeward side heat transfer tube and the tube diameter ratio between the two heat transfer tubes, specifically, the ratio between the tube diameter D1 of the most windward side heat transfer tube having the smallest diameter and the tube diameter D3 of the most leeward side heat transfer tube (D1/D3).

In FIG. 6, the performance of the heat exchanger is examined over six cases where the tube diameter D3 of the most leeward side heat transfer tube is 3.2 mm, 4 mm, 5 mm, 7 mm, 8 mm, and 9.52 mm. In each of the cases, the ability of the heat exchanger when D1=D2=D3 is 1.00 (the reference value), and the performance of the heat exchanger is evaluated in relative comparison with the above ability.

From FIG. 6, it is found that in all the five cases where the tube diameter D3 is 4 mm, 5 mm, 7 mm, 8 mm, and 9.52 mm, as the tube diameter ratio (D1/D3) is decreased less than 1, the ability of the heat exchanger is increased more than a case where the tube diameters of the three rows are all equal to each other at the beginning, reaches a peak in due course, and is decreased after that. There is a tendency that the smaller the tube diameter D3 is, the earlier the ability reaches a peak. It is found that in a case where the tube diameter ratio (D1/D3) is 0.6 and the tube diameter D3 is 4 mm, the ability of the heat exchanger is substantially equal to a case where the tube diameters of the three rows are all equal to each other.

In a case where the tube diameter D3 is 3.2 mm, it is found that as the tube diameter ratio (D1/D3) is decreased less than 1, the ability of the heat exchanger is gradually decreased. It can be thought that when the tube diameter D3 is too small, there is only the influence of the increase in the pressure loss, and even when the tube diameter ratio (D1/D3) is decreased, the heat exchanging ability is not improved but conversely lowered.

From the above, in a case of D1<D2=D3, it is found that when satisfying 4 mm≤D3≤10 mm, and 0.6≤D1/D3<1, the performance of the heat exchanger is improved more than a case where the tube diameters of the three rows are all equal to each other (D1=D2=D3).

Figure 7:
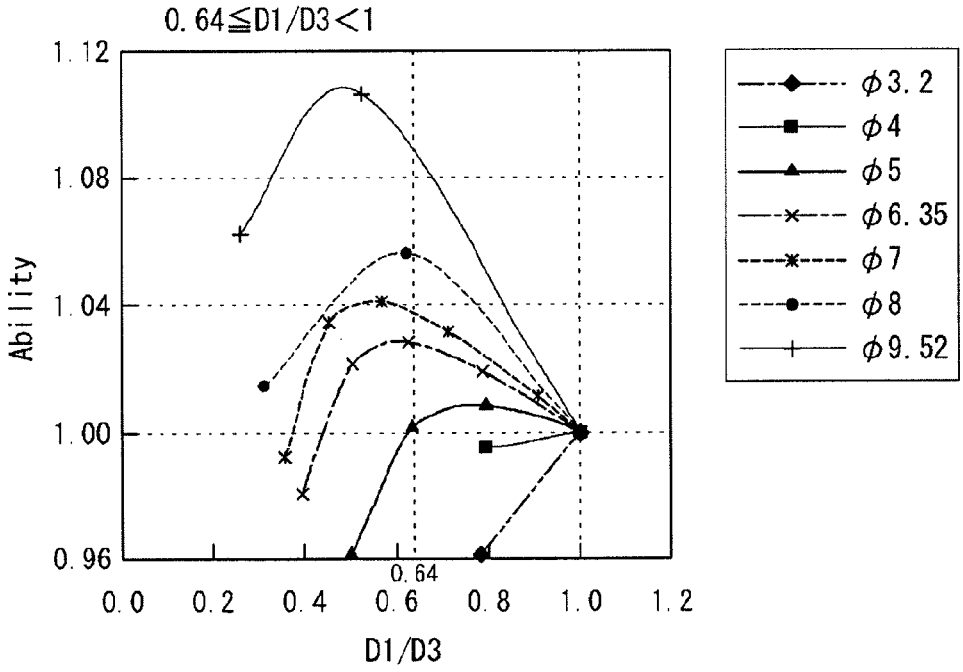
FIG. 7 is a graph showing a performance of the heat exchanger of the present invention.

FIG. 7 is a graph showing a performance of the heat exchanger of the present invention in a case of D1=D2<D3. The performance of the heat exchanger is evaluated by changing the tube diameter D3 of the most leeward side heat transfer tube and the tube diameter ratio between the two heat transfer tubes, specifically, the ratio between the tube diameter D1 of the most windward side heat transfer tube having the smallest diameter and the tube diameter D3 of the most leeward side heat transfer tube (D1/D3).

In FIG. 7, the performance of the heat exchanger is examined over seven cases where the tube diameter D3 of the most leeward side heat transfer tube is 3.2 mm, 4 mm, 5 mm, 6.35 mm, 7 mm, 8 mm, and 9.52 mm. In each of the cases, the ability of the heat exchanger when D1=D2=D3 is 1.00 (the reference value), and the performance of the heat exchanger is evaluated in relative comparison with the above ability.

From FIG. 7, it is found that in all the five cases where the tube diameter D3 is 5 mm, 6.35 mm, 7 mm, 8 mm, and 9.52 mm, as the tube diameter ratio (D1/D3) is decreased less than 1, the ability of the heat exchanger is increased more than a case where the tube diameters of the three rows are all equal to each other at the beginning, reaches a peak in due course, and is decreased after that. It is found that in a case where the tube diameter ratio (D1/D3) is 0.64 and the tube diameter D3 is 5 mm, the ability of the heat exchanger is substantially equal to a case where the tube diameters of the three rows are all equal to each other.

In cases where the tube diameter D3 is 3.2 mm and 4 mm, it is found that as the tube diameter ratio (D1/D3) is decreased less than 1, the ability of the heat exchanger is decreased. It can be thought that when the tube diameter D3 is too small, there is only the influence of the increase in the pressure loss, and even when the tube diameter ratio (D1/D3) is decreased, the heat exchanging ability is not improved but conversely lowered.

From the above, in a case of D1=D2<D3, it is found that when satisfying 5 mm≤D3≤10 mm, and 0.64≤D1/D3<1, the performance of the heat exchanger is improved more than a case where the tube diameters of the three rows are all equal to each other (D1=D2=D3).

Other Modified Example

It should be noted that the above embodiment is only an example and the present invention is not limited to such an embodiment. For example, in the above embodiment, the heat exchanger is arranged on the air outlet side of the fan. However, the present invention can also be applied to a heat exchanger arranged on the air inlet side of the fan.

In the above embodiment, the heat exchanger of the indoor unit is considered. However, the present invention can also be applied to a heat exchanger of an outdoor unit. Further, the heat exchanger of the present invention is not limited to a heat exchanger for an air conditioner but can also be applied to other equipment such as a heat exchanger for a refrigeration unit as long as the heat exchange is performed between the refrigerant flowing in the tubes and the air.

In the above embodiment, the indoor unit of the air conditioner for performing cooling and heating is considered. However, the present invention can also be applied to an indoor unit of an air conditioner for performing any one of the cooling and the heating.

In the above embodiment, the substantially annular heat exchanger is arranged so as to surround the fan in a center. However, as long as the three rows of the heat transfer tubes are arranged along the air flow direction, a shape or arrangement of the heat exchanger can be appropriately selected in accordance with an installment space or the like.

In the above embodiment, a relationship between the air flow and the refrigerant is parallel flows at the time of the cooling operation while being counter flows at the time of the heating operation. However, the relationship may be converse. That is, the refrigerant after passing through the expansion valve can be supplied from the most leeward side heat transfer tube at the time of the cooling operation, meanwhile, the refrigerant after being compressed by the compressor can be supplied from the most windward side heat transfer tube at the time of the heating operation. In this case, the liquid refrigerant or the refrigerant in a wet state of containing a large volume of the liquid refrigerant flows through the most leeward side heat transfer tube. Thus, the tube diameter of the most leeward side heat transfer tube has the smallest diameter.

REFERENCE SIGNS LIST

1: Heat exchanger
2: Indoor unit
4: Fan
20: Heat transfer tube
21: Fin

The invention claimed is:

1. A heat exchanger, in which a plurality of plate-shaped fins are attached to outer peripheries of heat transfer tubes through which a refrigerant flows, the heat exchanger exchanging heat between the refrigerant and the air, the heat exchanger comprising:

first, second, and third rows of heat transfer tubes arranged along a direction of an air flow, the air flow being generated by a fan, the second row being disposed between the first and third rows along the direction of the air flow; and first plate-shaped fins attached to the outer periphery of the heat transfer tube in the first row, second plate-shaped fins attached to the outer periphery of the heat transfer tube in the second row, and third plate-shaped fins attached to the outer periphery of the heat transfer tube in the third row, wherein:

among the first, second, and third rows of the heat transfer tubes:

a tube diameter of the heat transfer tube in the first row is D1, a tube diameter of the heat transfer tube in the second row is D2, a tube diameter of the heat transfer tube in the third row is D3,

D1<D2,

D2=D3, 4 mm≤D3≤10 mm, and 0.6≤D1/D3<1;

the heat exchanger is configured for use as an evaporator such that:

the heat transfer tube of the first row is operated as an inlet, and the fan operates so that the direction of air flow makes the first row the most leeward of the first, second, and third rows;

the refrigerant flowing through the heat exchanger contains a highest percentage of liquid refrigerant flows through the heat transfer tube in the first row; and a width of the first plate-shaped fins is larger than widths of the second plate-shaped fins and the third plate-shaped fins.

2. A heat exchanger, in which a plurality of plate-shaped fins are attached to outer peripheries of heat transfer tubes through which a refrigerant flows, the heat exchanger exchanging heat between the refrigerant and the air, the heat exchanger comprising:

first, second, and third rows of heat transfer tubes arranged along a direction of an air flow, the air flow being generated by a fan, the second row being disposed between the first and third rows along the direction of the air flow; and first plate-shaped fins attached to the outer periphery of the heat transfer tube in the first row, second plate-shaped fins attached to the outer periphery of the heat transfer tube in the second row, and third plate-shaped fins attached to the outer periphery of the heat transfer tube in the third row, wherein:

among the first, second, and third rows of the heat transfer tubes:

a tube diameter of the heat transfer tube in the first row is D1, a tube diameter of the heat transfer tube in the second row is D2, a tube diameter of the heat transfer tube in the third row is D3, $D1=D2$, $D2<D3$, $5\text{ mm}\leq D3\leq 10\text{ mm}$, and $0.64\leq D1/D3<1$;

the heat exchanger is configured for use as an evaporator such that:

the heat transfer tube of the first row is operated as an inlet, and the fan operates so that the direction of air flow makes the first row the most leeward of the first, second, and third rows;

the refrigerant flowing through the heat exchanger contains a highest percentage of liquid refrigerant flows through the heat transfer tube in the first row; and a width of the first plate-shaped fins is larger than widths of the second plate-shaped fins and the third plate-shaped fins.

3. A heat exchanger, in which a plurality of plate-shaped fins are attached to outer peripheries of heat transfer tubes through which a refrigerant flows, the heat exchanger exchanging heat between the refrigerant and the air, the heat exchanger comprising:

first, second, and third rows of heat transfer tubes arranged along a direction of an air flow, the air flow being generated by a fan, the second row being disposed between the first and third rows along the direction of the air flow; and first plate-shaped fins attached to the outer periphery of the heat transfer tube in the first row, second plate-shaped fins attached to the outer periphery of the heat transfer tube in the second row, and third plate-shaped fins attached to the outer periphery of the heat transfer tube in the third row, wherein:

among the first, second, and third rows of the heat transfer tubes:

a tube diameter of the heat transfer tube in the first row is D1, a tube diameter of the heat transfer tube in the second row is D2, a tube diameter of the heat transfer tube in the third row is D3, $D1<D2$, $D2<D3$, $5\text{ mm}\leq D3\leq 10\text{ mm}$, $0.5\leq D1/D3<1$, and $0.75\leq D2/D3<1$;

the heat exchanger is configured for use as an evaporator such that:

the heat transfer tube of the first row is operated as an inlet, and the fan operates so that the direction of air flow makes the first row the most leeward of the first, second, and third rows;

the refrigerant flowing through the heat exchanger contains a highest percentage of liquid refrigerant flows through the heat transfer tube in the first row; and a width of the first plate-shaped fins is larger than widths of the second plate-shaped fins and the third plate-shaped fins.

4. The heat exchanger according to claim 1 or 3, wherein a tube diameter of the heat transfer tube in the first row is within a range of 3 to 4 mm.

5. An indoor unit comprising:

the heat exchanger according to claim 1 or 3, and the fan which generates the air flow, wherein the refrigerant flows from the first row toward the third row at the time of a cooling operation while alternatively flowing from the third row toward the first row at the time of a heating operation.

6. The indoor unit according to claim 5, wherein a tube diameter of the heat transfer tube in the first row is within a range of 3 to 4 mm.

7. The indoor unit according to claim 5, wherein the fan is substantially arranged in a center of a casing arranged on the back side of a ceiling, the heat exchanger is arranged in the casing so as to surround the fan, and the heat transfer tube in the first row is the outermost side heat transfer tube of the heat exchanger.

8. An indoor unit comprising:

the heat exchanger according to claim 2, and the fan which generates the air flow, wherein the refrigerant flows from the first row toward the third row at the time of a cooling operation while alternatively flowing from the third row toward the first row at the time of a heating operation.

9. The indoor unit according to claim 2 or 8, wherein a tube diameter of the heat transfer tube in the first row is within a range of 3.2 to 4 mm.

* * * * *